US005401424A

United States Patent [19]

Vinci et al.

[11] Patent Number: 5,401,424

[45] Date of Patent: Mar. 28, 1995

[54] MIXED CARBOXYLATE OVERBASED GELS

[75] Inventors: James N. Vinci, Mayfield Heights; William R. Sweet, Cleveland Heights, both of Ohio

[73] Assignee: The Lubrizol Corporation, Wickliffe, Ohio

[21] Appl. No.: 130,952

[22] Filed: Oct. 4, 1993

[51] Int. Cl.[6] ..... C10M 125/00

[52] U.S. Cl. ..... 252/18; 252/38; 252/39; 51/293; 106/807; 106/810; 507/140

[58] Field of Search ..... 252/18, 38

[56] References Cited

U.S. PATENT DOCUMENTS

| | | | |
|---|---|---|---|
| 2,842,495 | 7/1958 | Morway et al. | 252/39 |
| 2,850,457 | 9/1958 | Thompson et al. | 252/39 |
| 3,018,249 | 1/1962 | Morway | 252/39 |
| 3,170,879 | 2/1965 | Butcosk | 252/18 |
| 3,202,606 | 8/1965 | Morway | 252/33 |
| 3,242,079 | 3/1966 | McMillen | 252/33 |
| 3,372,115 | 3/1968 | McMillen | 252/33 |
| 3,372,116 | 3/1968 | Meinhardt et al. | 252/36 |
| 3,492,231 | 1/1970 | McMillen | 252/33 |
| 3,544,463 | 12/1970 | Koft | 252/33 |
| 3,730,895 | 5/1973 | Kjonaas | 252/18 |
| 3,766,066 | 10/1973 | McMillen | 252/32.7 E |
| 3,766,067 | 10/1973 | McMillen | 252/33 |
| 4,597,880 | 7/1986 | Elides | 252/33.4 |
| 4,698,170 | 10/1987 | Le Coent | 252/33.2 |

*Primary Examiner*—Ellen M. McAvoy

*Attorney, Agent, or Firm*—David M. Shold; Frederick D. Hunter

[57] ABSTRACT

Gelled overbased materials are prepared by mixing an overbased composition of a metal salt of an organic acid material containing at least 8 carbon atoms, a metal salt of an organic acid material containing fewer than 6 carbon atoms, and a metal carbonate in an oleophilic medium, with an alcohol or an alcohol-water mixture, and heating the mixture.

71 Claims, No Drawings

MIXED CARBOXYLATE OVERBASED GELS

BACKGROUND OF THE INVENTION

The present invention relates to a process for preparing gelled overbased materials and to lubricants and other substances containing such gelled overbased materials.

Overbased materials have been long known and are important lubricating oil additives. These materials are metal salts of acidic organic compounds. Overbased materials are single phase, homogeneous, and generally apparently Newtonian systems characterized by a metal content in excess of that which would be present according to the stoichiometry of the metal and the particular acidic organic compound reacted with the metal. Overbased materials can be converted from their original Newtonian form to a gelled form by a variety of treatments, some of which are set forth in certain of the following documents:

U.S. Pat. No. 3,242,079, McMillen, discloses a grease prepared by mixing mineral oil, a carbonated, basic alkaline earth metal salt of an acid of at least 12 carbon atoms, and an active hydrogen compound such as a lower aliphatic carboxylic acid, water, or water-alcohol mixtures. Addition of acetic acid and mineral oil to overbased calcium petroleum sulfonate and heating to 100°-150° C. for about 9 hours forms a grease. Examples illustrate the use of alcohol/water to effect the grease formation.

U.S. Pat. No. 3,492,231, McMillen, discloses preparation of a non-Newtonian disperse system. The conversion agents include lower aliphatic carboxylic acids, water, aliphatic alcohols, cycloaliphatic alcohols, phenols, ketones, aldehydes, amines, boron acids, phosphorus acids, and carbon dioxide. Mixtures of two or more of these conversion agents are also useful. The use of a mixture of water and one or more of the alcohols is especially effective.

U.S. Pat. No. 3,766,066, McMillen, discloses a process for preparing solid, metal-containing compositions by isolating the solid from a gelled overbased material.

U.S. Pat. No. 4,597,880, Eliades, discloses a 1-step process for making overbased calcium sulfonate greases, comprising introducing into a reactor a solution of a sulfonic acid having an aliphatic chain of at least 12 carbon atoms; calcium oxide and/or calcium hydroxide; minor proportions of (a) water-soluble carboxylic acids such as, for example, acetic acid; (b) aliphatic alcohols or alkoxyalkanols, such as methyl alcohol or methyl cellosolve; and (c) water, prior to carrying out a carbonation step.

U.S. Pat. No. 3,730,895, Kjonaas, discloses a calcium overbased carboxylate. Example 6 shows the preparation of a concentrate composition using a dispersant comprising a combination of carboxylates overbased with calcium carbonate. Glacial acetic acid and 12-hydroxystearic acid are employed. The product has the appearance of a grease. The concentrate was blended with a lithium soap based grease composition.

The present invention provides an improved method for converting a Newtonian overbased material to a gel. The present invention further provides a method for preparing certain of the Newtonian overbased materials which are suitable for subsequent conversion to gels. Gels prepared from overbased saturated carboxylates often show improved thickening efficiency and utility in greases, paints, and other applications, compared to gels prepared from unsaturated carboxylates or other overbased materials in general. But the process for preparing such gelled overbased saturated carboxylates or their equivalents is generally quite difficult. The initial overbasing of saturated carboxylic acids is complicated. While one might overbase such acids in a higher alcohol Carrier solvent such as isooctyl alcohol at 150°-160° C., removing the water of reaction as it is formed, such a process would have disadvantages. For example, a relatively high temperature is required, and the product is formed in an alcohol solvent, which may be undesirable. Alternatively, one might attempt to use an aromatic carrier such as toluene, mixed xylenes, or higher aromatics, conducting the overbasing reaction at 50°-55° C. In such a process the mixture tends to solidify during the overbasing, even with extreme dilution with the carrier solvent, thus preventing effective preparation of the overbased material. Thus by this second possible route overbased coconut oil can be prepared, but only with difficulty, yielding a solid product even at 21% concentration. And overbased stearic, palmitic, or 12-hydroxystearic acids cannot generally be prepared by this route at all, whether the starting material be the acid, ester, or triglyceride. The gelation of such overbased carboxylic acids, once they are prepared, is likewise difficult and slow, often requiring treatment for several hours at elevated temperature even in the presence of a conversion agent.

SUMMARY OF THE INVENTION

The present invention provides a process for preparing a gelled overbased material, comprising the steps of preparing a mixture of (i) a fluid carbonated overbased material in an oleophilic medium, which mixture contains a metal salt of at least one organic acid material containing at least 8 carbon atoms and a metal salt of at least one organic acid material containing fewer than 6 carbon atoms, and (ii) an alcohol or an alcohol-water mixture; and heating the mixture.

The invention further provides a process for preparing an overbased composition, comprising the steps of combining a source of an acid material of at least 8 carbon atoms, a selected aromatic solvent, and a stoichiometric excess of a metal base, and carbonating the mixture. Alternatively, the medium can be a polar oleophilic medium and the carbonation can be conducted at 70°-95° C. Preferably the acid material is a saturated carboxylic acid.

DETAILED DESCRIPTION OF THE INVENTION

In order to fully explain the present invention, the general processes involved in preparing overbased materials will be discussed.

The overbased materials, which are contained in the oleophilic medium, are well known materials. Overbasing, also referred to as superbasing or hyperbasing, is a means for supplying a large quantity of basic material in a form which is soluble or dispersable in oil. Overbased products have been long used in lubricant technology to provide detergent additives.

Overbased materials are single phase, homogeneous systems characterized by a metal content in excess of that which would be present according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention often have a metal ratio of 1.5 to 30, preferably 3 to 25, and more preferably 7 to 20.

The overbased materials are prepared by reacting an acidic material, normally an acidic gas such as $SO_2$ or $CO_2$, and most commonly carbon dioxide, with a mixture comprising an acidic organic compound, a reaction medium normally comprising an oleophilic medium, a stoichiometric excess of a metal base, and preferably a promoter.

The oleophilic medium used for preparing and containing overbased materials will normally be an inert solvent for the acidic organic material. The oleophilic medium can be an oil or an organic material which is readily soluble or miscible with oil. Suitable oils include oils of lubricating viscosity, including natural or synthetic lubricating oils and mixtures thereof. Natural oils include animal oils; vegetable oils including sunflower oils, including high oleic sunflower oil available under the name Trisun TM 80, rapeseed oil, and soybean oil; mineral lubricating oils of paraffinic, naphthenic, or mixed types; solvent or acid treated mineral oils; and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of monocarboxylic acids and polyols, esters of phosphorus-containing acids, polymeric tetrahydrofurans, and silicon-based oils (including siloxane oils and silicate oils). Included are unrefined, refined, and rerefined oils. Specific examples of oils are described in U.S. Pat. No. 4,326,972.

Suitable organic materials which are readily soluble or miscible with oil are generally substantially non-polar or non-protic materials which are liquids at room temperature. They are preferably volatile liquids which can be removed by evaporation or distillation if desired. Suitable materials include alkanes and haloalkanes of 5 to 30 carbon atoms, polyhaloalkanes, cycloalkanes of 5 or more carbon atoms, alkyl substituted alkanes, aryl hydrocarbons, alkylaryl hydrocarbons, haloaryl hydrocarbons, ethers such as dialkyl ethers, alkyl aryl ethers, cycloalkyl ethers, alkanoic acid esters, silicate esters, and mixtures of these. Also useful are low molecular weight liquid polymers, generally classified as oligomers, including dimers, tetramers, pentamers, etc., including such materials as propylene tetramers and isobutylene dimers. Also useful are liquid petroleum fractions such as naphthene-based or paraffin-based petroleum fractions.

The acidic organic compounds useful in making overbased compositions include carboxylic acids, sulfonic acids, phosphorus-containing acids, phenols or mixtures of two or more thereof. The preferred acid materials are carboxylic acids. (Any reference to acids, such as carboxylic, or sulfonic acids, is intended to include the acid-producing derivatives thereof such as anhydrides, alkyl esters, acyl halides, lactones and mixtures thereof unless otherwise specifically stated.)

The carboxylic acids useful in making overbased salts may be aliphatic or aromatic, mono- or polycarboxylic acid or acid-producing compounds. These carboxylic acids include lower molecular weight carboxylic acids as well as higher molecular weight carboxylic acids (e.g. having more than 8 or more carbon atoms).

Carboxylic acids, particularly the higher carboxylic acids, are preferably soluble in the oleophilic medium. Usually, in order to provide the desired solubility, the number of carbon atoms in a carboxylic acid should be at least about 8, e.g., 8 to 400, preferably 10 to 50, and more preferably 10 to 22.

The carboxylic acids include saturated and unsaturated acids. Examples of such useful acids include dodecanoic acid, decanoic acid, tall oil acid, 10-methyltetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene (Mn=200–1500), polypropenyl-substituted succinic acid derived from a polypropene, (Mn=200–1000), octadecyl-substituted adipic acid, chlorostearic acid, 12-hydroxystearic acid, 9-methylstearic acid, dichlorostearic acid, ricinoleic acid, lesquerellic acid, stearyl-benzoic acid, eicosanyl-substituted naphthoic acid, dilauryl-decahydronaphthalene carboxylic acid, mixtures of any of these acids, their alkali and alkaline earth metal salts, their ammonium salts, their anhydrides, and/or their esters, triglycerides, etc. A preferred group of aliphatic carboxylic acids includes the saturated and unsaturated higher fatty acids containing from about 12 to about 30 carbon atoms. Other acids include aromatic carboxylic acids including substituted and non-substituted benzoic, phthalic and salicylic acids or anhydrides, most especially those substituted with a hydrocarbyl group containing about 6 to about 80 carbon atoms. Examples of suitable substituent groups include butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like. Suitable materials also include derivatives functionalized by addition of sulfur, phosphorus, halogen, etc.

Sulfonic acids are also useful in making overbased salts and include the sulfonic and thiosulfonic acids. The sulfonic acids include the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)+T$ contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight (Mn) in the range of 500 to 5000 with chlorosulfonic acid, nitronaphthalene sulfonic acid, paraffin wax sulfonic acid, cetyl-cyclopentane sulfonic acid, lauryl-cyclohexane sulfonic acids, polyethylenyl-substituted sulfonic acids derived from polyethylene (Mn=300–1000), etc. Normally the aliphatic groups will be alkyl and/or alkenyl groups such that the total number of aliphatic carbons is at least about 8.

Another group of sulfonic acids are mono-, di-, and tri-alkylated benzene and naphthalene (including hydrogenated forms thereof) sulfonic acids. Such acids include di-isododecyl-benzene sulfonic acid, polybutenyl-substituted sulfonic acid, polypropylenyl-substituted sulfonic acids derived from polypropene having an Mn=300–1000, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 37.8° C. (100° F.) to about 200 seconds at 98.9° C. (210° F.); petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids (the material leftover after the removal of dodecyl benzene sulfonic acids that are used for household detergents). The production of sulfonates from detergent manufactured by-products by reaction with, e.g., $SO_3$, is well known to those skilled in the art.

Phosphorus-containing acids are also useful in making basic metal salts and include any phosphorus acids such as phosphoric acid or esters; and thiophosphorus acids or esters, including mono and dithiophosphorus acids or esters. Preferably, the phosphorus acids or esters contain at least one, preferably two, hydrocarbyl groups containing from 1 to about 50 carbon atoms. The phosphorus-containing acids useful in the present invention are described in U.S. Pat. No. 3,232,883 issued to Le Suer.

The phenols useful in making basic metal salts are generally represented by the formula $(R_1)_a$—Ar—$(OH)_b$, wherein $R_1$ is a hydrocarbyl group; Ar is an aromatic group; a and b are independently numbers of at least one, the sum of a and b being in the range of two up to the number of displaceable hydrogens on the aromatic nucleus or nuclei of Ar. $R_1$ and a are preferably such that there is an average of at least about 8 aliphatic carbon atoms provided by the $R_1$ groups for each phenol compound. The aromatic group as represented by "Ar" can be mononuclear such as a phenyl, a pyridyl, or a thienyl, or polynuclear.

The metal compounds useful in making the basic metal salts are generally any Group I or Group II metal compounds (CAS version of the Periodic Table of the Elements). The Group I metals of the metal compound include alkali metals (sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (magnesium, calcium, barium, etc.) as well as the Group IIB metals such as zinc or cadmium. Preferably the Group II metals are magnesium, calcium, barium, or zinc, preferably magnesium or calcium, more preferably calcium. Generally the metal compounds are delivered as metal salts. The anionic portion of the salt can be hydroxyl, oxide, carbonate, borate, nitrate, etc.

Promoters are chemicals which are sometimes employed to facilitate the incorporation of metal into the basic metal compositions. Among the chemicals useful as promoters are water, ammonium hydroxide, organic acids of up to about 8 carbon atoms, nitric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols. It is characteristic of promoters that they are normally employed in low quantities, normally at less than 1–2% by weight of the reaction mixture for promoters which are not later removed. Thus they do not normally constitute an appreciable portion of the acid functionality of the composition, but serve rather a role more as a catalyst for the overbasing process.

In preparing overbased materials, the organic acid material to be overbased normally is brought together in an inert oleophilic medium, with the metal base, the promoter, and the carbon dioxide (introduced by bubbling gaseous carbon dioxide into the mixture), and a chemical reaction ensues. The reaction temperature is usually about 27°–159° C. (80°–300° F.), more often about 38°–93° C. (100°– 200° F.). The exact nature of the resulting overbased product is not known, but it can be described as a single phase homogeneous mixture of the solvent and either (1) a metal complex formed from the metal base, the carbon dioxide, and the organic acid and/or (2) an amorphous metal salt formed from the reaction of the carbon dioxide with the metal base and the organic acid. For purposes of the present invention the overbased material can be described as a mixture of a metal salt of an organic acid material with a metal carbonate.

A more complete description of the process for preparing ordinary overbased materials can be found in U.S. Pat. No. 3,766,067, McMillen.

One aspect of the present invention relates to an improved process for preparing overbased material which can be used to form the gels which are described in greater detail below. While the process which is described below can be advantageously used for overbasing organic acidic materials in general (including saturated and unsaturated carboxylic acids, phosphonic acids, sulfonic acids, and phenols), it is particularly suitable for preparing overbased saturated carboxylates.

It has been mentioned above that higher saturated carboxylic acids are difficult to overbase by ordinary methods. One preferred aspect of the invention, therefore, relates specifically to the overbasing of saturated carboxylic acids or their functional equivalents, containing at least 8 carbon atoms in the acid portion, and in particular containing 12 to 30 carbon atoms in the acid portion. Examples of such acids include coconut acid, hydrogenated palmitic acid, hydrogenated castor acid, stearic acid, 12-hydroxystearic acid, and 14-hydroxyarachidic acid; other such acids will be apparent to one skilled in the art.

The acid to be overbased can be present as the acid itself, or it can be supplied in the form of an alternative source for such acid, that is, another material which will react under the conditions of the overbasing to produce the desired overbased product, possibly by means of forming the actual acid as an intermediate in situ. Thus, for example, suitable acid sources include the acids themselves as well as esters, amides, anhydrides, and salts of the acids. A preferred acid source is the vegetable oil based on the acid, e.g., palm oil, or coconut oil. The source can likewise be a hydrogenated vegetable oil, derived from an unsaturated vegetable oil. Vegetable oils are generally triglycerides. In the alkaline environment of the overbasing reaction, the oils are believed to be saponified to form the salt, which is then overbased, although the present invention is not intended to be limited by any such theoretical explanation.

The overbasing reaction for this aspect of the present invention is accomplished using a metal base, as in ordinary overbasing reactions. Suitable metal bases include those described above, preferably calcium hydroxide or calcium oxide. Likewise a promoter or other customary chemicals can be used, as described above.

The overbasing process for saturated carboxylic acids and their equivalents is accomplished using a solvent or medium in which the acid source, the basic metal source, and any additional materials such as alcohol promoters are dissolved or suspended. The medium for the present aspect of the invention is a polar oleophilic medium. By the expression "polar oleophilic medium" is meant a material which is compatible with oil yet has sufficient polar or polarizable character to provide a measure of solubility or compatibility with the aforementioned acids or acid sources. Ordinary mineral oil or mineral spirits are sometimes not sufficiently polar to provide optimum solution or suspension of the saturated acids. On the other hand, some aromatic solvents do have a suitable degree of polarity along with a suitable boiling point to permit the use of higher carbonation temperature. In some instances commercial mixed xylene solvent, which is predominantly paraxylene, is not particularly suitable, perhaps because of the relatively low polarity, as measured by dielectric constant, of the para-xylene. The dielectric constant of para-xylene at 20° C. is reported in the "Handbook of Chemistry and Physics," 50th edition, Chemical Rubber Company, as 2.270 units. That of meta-xylene is 2.374 (20° C.), which is about the same as that of toluene, 2.239 (25° C.). The dielectric constant of ortho-xylene, however, is reported as 2.568 (at 20° C.). It appears that relatively inert aromatic materials having a polarity of at least 2.4 units will be desirable for use as the medium for this aspect of the invention. A useful range is 2.4 to 10, preferably 2.5 to 6. Examples of aromatic materials having a suitable degree of polarity include chlorobenzene, ortho-, meta-, and para-dichlorobenzene, chloro- and bromotoluenes, and ortho-xylene, which is preferred. In the latter case in particular, overbased materials can be prepared from stearic, palmitic, and 12-hydroxystearic, and other saturated acids and their rective equivalents in a readily usable form. Of course , the aromatic material selected to serve as the medium should not have functionality which would interfere with the overbasing reaction, i.e., the materials should be inert under the conditions of the reaction. For this reason materials such as phenol would be inappropriate as solvents, since phenol would itself react with the base employed to form a salt.

Carbonation reactions in general are well known and have been described above. A practical temperature limitation in a carbonation reaction is the boiling point at ambient pressure of a promoter material, such as isopropanol (b.p. 82° C.). The carbonation of the mixture of the present aspect of the invention is preferably conducted at a temperature within a range of 70° to 95° C., and more preferably 80° to 85° C., preferably in ortho-xylene (which has a normal boiling point of 144° C.). Overbasing by this preferred process avoids problems of solidification or formation of high viscosity material, before, during, or after the carbonation reaction. The product in orthoxylene is generally a liquid, even at concentrations of 50% or more.

The overbased saturated carboxylate material of this first aspect of the invention can be used as a lubricant additive without further treatment, or it can be convered to a gel. This conversion can be effected by conventional methods if desired, or it can be effected by the improved gelation process set forth below. The improved gelation process is applicable, however, to more materials than those prepared from saturated carboxylic acids alone.

Turning now to this second aspect of the invention, relating to the improved gelation process, it is seen that the process of the present invention differs from that previously employed for preparing and gelling overbased materials generally. The initial overbased material which is further treated (as described below) is a mixture containing a salt of at least one organic acid material of at least 8 carbon atoms and a salt of at least one organic material of fewer than 6 carbon atoms, or a mixed salt containing such higher and lower acid materials. The salt of the organic acid material of at least 8 carbon atoms can be the overbased saturated carboxylic acid as prepared above. This overbased mixture, however, can be prepared by overbasing a mixture of the higher acid and the lower acid, or by adding a metal salt of the lower acid to an overbased composition of the higher acid, or by adding to an overbased composition of the higher acid a substance which forms a metal salt of the lower acid upon interacting with a metal base, or by any equivalent methods. It is convenient, for example, to prepare the mixture by premixing equivalent amounts of a lower acid (such as acetic acid) and a metal base (such as calcium hydroxide) in an inert vehicle (such as mineral oil) and admixing the thus prepared mixture with an overbased composition prepared as described above.

Therefore in one embodiment, the invention involves preparing the fluid carbonated overbased material by reacting a mixture of at least one organic acid material containing at least 8 carbon atoms or a reactive equivalent thereof and at least one organic acid material containing fewer than 6 carbon atoms or a reactive equivalent thereof with a stoichiometric excess of a metal salt and carbonating the mixture. In an alternative embodiment the invention involves preparing the fluid carbonated overbased material by reacting at least one organic acid material containing at least 8 carbon atoms or a reactive equivalent thereof with a stoichiometric excess of a metal salt, carbonating the mixture, and adding to the mixture a metal salt of an organic acid material containing fewer than 6 carbon atoms or a substance which forms a metal salt of an organic acid material containing fewer than 6 carbon atoms upon interaction with a metallic base.

The amount of carbonated overbased material normally will comprise 1 to 70 weight percent, and preferably 10 to 50 weight percent, of the overall composition to be gelled.

The higher acid used in this aspect of the present invention is an acid containing at least 8 carbon atoms. It is preferably a carboxylic acid containing 10 to 22 carbon atoms. Numerous examples of such acids are set forth in the description above, and include, but are not limited to, saturated carboxylic acids.

The lower acid used in this aspect of the present invention is an organic acid containing fewer than 6 carbon atoms. Preferred acids include formic acid, acetic acid, propionic acid, butyric acid, valeric acid, branched chain isomers of such acids, and mixtures of such acids. The acid used can be a mono- or polybasic acid, but monobasic acids are preferred. (Acetic acid is more effective than adipic acid, a 6-carbon acid, which by itself is not believed to be particularly effective.) The acid preferably contains 1 to 4 carbon atoms. The acid may be substituted with functional substituents (such as halogen, alkyloxy, hydroxy, or amino substituents) which do not substantially interfere with the functioning of the acid as described below, but preferably the acid is an unsubstituted carboxylic acid. The most preferred lower acid is acetic acid, although materials functionally equivalent to acetic acid (e.g. acetic anhydride, ammonium acetate, acetyl halides, or acetate esters) can also be used.

The function of the organic acid having fewer than 6 carbon atoms is to aid in the gelation of the overbased material. Ungelled overbased materials, prepared according to the process described above, are normally Newtonian materials which are homogeneous on a macroscopic scale. (The particular mixed overbased materials of the present invention may not be completely homogeneous if, for example, the lower acid material is supplied by admixing solid calcium acetate into an overbased composition of e.g. calcium stearate.) These ordinary overbased materials can be gelled, i.e. converted into a gel-like or colloidal structure, by homogenizing a "conversion agent" and the overbased starting material.

The terminology "conversion agent" is intended to describe a class of very diverse materials which possess the property of being able to convert the Newtonian homogeneous, single-phase, overbased materials into non-Newtonian colloidal disperse systems. The mechanism by which conversion is accomplished is not completely understood. However, with the exception of carbon dioxide, these conversion agents generally possess active hydrogens. The conversion agents include lower aliphatic carboxylic acids, water, aliphatic alcohols, polyethoxylated materials such as polyglycols, cycloaliphatic alcohols, arylaliphatic alcohols, phenols, ketones, aldehydes, amines, boron acids, phosphorus acids, sulfur acids, and carbon dioxide (particularly in combination with water). Mixtures of two or more of these conversion agents are also useful. Particularly useful conversion agents are alcohols having less than about twelve carbons while the lower alkanols, i.e., alkanols having less than about eight carbon atoms are preferred for reasons of economy and effectiveness in the process.

The use of a mixture of water and one or more of the alcohols is known to be especially effective for converting the overbased materials to colloidal disperse systems. Any water-alcohol combination is effective but a very effective combination is a mixture of one or more alcohols and water in a weight ratio of alcohol to water of from about 0.05:1 to about 24:1. Preferably at least one lower alkanol is present in the alcohol component of these water-alkanol mixtures. Water-alkanol mixtures wherein the alcoholic portion is one or more lower alkanols are especially suitable.

Homogenization, and thus gelation, is normally achieved by vigorous agitation of the conversion agent and the overbased starting materials, preferably at the reflux temperature or a temperature slightly below the reflux temperature, commonly 25° C. to 150° C. or slightly higher.

The concentration of the conversion agent necessary to achieve conversion of the overbased material is preferably within the range of 1% to 60% and more preferably 5 to 30%, based upon the weight of the overbased material.

Conversion of overbased materials to a colloidal disperse system is described in more detail in U.S. Pat. No. 3,492,231 (McMillen). It has been found that the techniques disclosed by McMillen and outlined above are effective for converting certain overbased materials (e.g. many of those based on hydrocarbylsulfonic acids) to gels. However, sometimes the conversion proceeds more slowly than desired, and such is often the case when the overbased material is prepared from a carboxylic acid and when the conversion agent is an alcohol or an alcohol-water mixture. Furthermore, when carboxylic acids are used it is sometimes necessary to employ higher molecular weight alcohols which are comparatively non-volatile and thus difficult to remove. It is in such cases that the present invention, which specifically provides for the presence of a lower acid material (or salt or equivalent thereof), is most useful. The presence of the lower acid has been found to significantly increase the rate of conversion in many instances and permit the more effective use of lower molecular weight alcohols as conversion agents.

The amount of the organic acid material having fewer than 6 carbon atoms is an amount suitable to provide a measurable increase in the rate of conversion or gelation of the overbased composition. More specifically, the molar ratio of the acid of fewer than 6 carbon atoms to the acidic organic material of at least 8 carbon atoms is preferably 0.2:1 to 5:1, and more preferably 0.5:1 to 2:1. When less than 0.2 parts are used the effect of the invention is less pronounced, and when more than 5 parts are used there is little further practical advantage to be gained. Within approximately this range, the rate of gelation increases with increasing content of the lower acidic organic material.

In the practice of the present invention the overbased mixture of higher and lower acids described above is admixed with an alcohol or alcohol-water mixture, preferably an isopropanol-water mixture in a weight ratio of 1:1 to 4:1, preferably about 2:1. The amount of the alcohol or alcohol water mixture is preferably about 5 to about 30 percent by weight of the fluid overbased composition. The mixture is agitated by stirring or by other means to effect good dispersion of all the components, and the mixture is heated. Heating to a temperature of 60° to 100° C. is normally sufficient to effect gelation of the mixture, normally within a period of minutes, e.g. 15–90 minutes or less, typically 45–60 minutes.

The gelled material obtained thereby may be used without further treatment. However, it is often desirable to remove the volatile materials, such as water and alcohol conversion agents, from the composition. This can be effected by further heating the composition to 100°–200° C. for a sufficient length of time to achieve the desired degree of removal. The heating may be conducted under vacuum if desired, in which case the temperatures and times can be adjusted in a manner which will be apparent to the person skilled in the art.

Removal of volatile materials need not be limited to removal of the conversion agents, however. It is possible, for instance, to completely isolate the solid components of the gelled material as dry or nearly dry solids. (In this context the term "solid" or "solids" includes not only sensibly dry materials, but also materials with a high solids content which still contain a relatively small amount of residual liquid.) Isolation of solids can be effected by preparing the composition in an oleophilic medium which is a volatile organic compound. The term "volatile" as used in this context describes a material which can be removed by evaporation. Xylenes, for example, would be considered volatile organic compounds. Heating of the gel to a suitable temperature and/or subjecting it to vacuum can lead to removal of the volatile oleophilic medium to the extent desired. Typical methods of drying include bulk drying, vacuum pan drying, spray drying, flash stripping, thin film drying, vacuum double drum drying, indirect heat rotary drying, and freeze drying. Other methods of isolation of the solids can also be employed, and some of those methods do not require that the oleophilic medium be a volatile material. Thus in addition to evaporation, such methods as dialysis, precipitation, extraction, filtration, and centrifugation can be employed to isolate the solid components of the gel.

The solid material thus isolated may be stored or transported in this form and later recombined with an appropriate amount of a medium such as an oleophilic medium (e.g. an oil). The redispersion into oil can be accomplished more readily when the solid material is not dried to absolute dryness, i.e. when a small amount of solvent remains in the composition. Alternatively an appropriate amount of an oil such as a mineral oil, a natural oil such as vegetable oil e.g. coconut oil or the like, or synthetic oil, or a surfactant, can be present in the nominally dry powder to aid in dispersion. The residual solvent, oil, or surfactant can preferably be present in amounts of 0.5 to 15 percent by weight, preferably 5 to 10 percent by weight. The solids materials, when dispersed in an appropriate medium, can provide a gel, a coating composition, a grease, another lubricant, or any of the materials which can be prepared from the originally gelled material. The solid materials can also be used without redispersion for their intrinsic lubricating properties.

It is also possible to prepare a dispersion of a gel in an oil or in an oleophilic medium different from that in which the gel was originally prepared, i.e., a "replacement medium," by a solvent exchange process. Such an alternative process avoids the necessity of preparing a dried powder and redispersing it in the second, or replacement medium, and thus can eliminate one or more processing steps. The first step in one embodiment of this modified process is the preparation of a gel in a volatile polar, oleophilic medium as described in greater detail above. To this gel is admixed the oil or other material which is desired as the replacement medium. When this replacement medium is significantly less volatile than the original medium, the original medium (along with any other volatile components) can be removed by heating or evaporation or stripping, leaving behind the less volatile replacement medium containing the overbased gel particles. Of course, the two liquid media can be separated by other physical or chemical methods appropriate to the specific combination of materials at hand, which will be apparent to one skilled in the art.

The processes and compositions of the present invention can be used to prepare a variety of materials useful as additives for coating compositions, as stabilizing agents or additives for such compositions as polymeric compositions or for drilling muds or other down-hole oil field applications, as rheology control agents for water solutions, such as paints and invert emulsions, as lubricants (including greases) for oil field, automotive, steel mill, mining, railroad, and environmentally friendly applications, as lubricants for food-grade applications, metalworking, and preservative oils, as lubricants for abrasives (grinding aids), as a component of synthetic based invert lubricants, and in thermal stabilizer compositions for polymers such as polyvinyl chloride resin Coating compositions include paints, certain inks, and various varnishes and lacquers. They often contain pigments in a dispersing medium or vehicle, a film-forming organic polymer, and other conventional additives known to those skilled in the art.

Drilling fluid or mud used in oil-field applications functions principally to carry chips and cuttings produced by drilling to the surface; to lubricate and cool the drill bit and drill string; to form a filter cake which obstructs filtrate invasion in the formation; to maintain the walls of the borehole; to control formation pressures and prevent lost returns; to suspend cuttings during rig shutdowns; and to protect the formation for later successful completion and production. Drilling fluids or muds are preferably able to suspend cuttings and weighting materials upon stopping of circulation of the drilling fluid. It is further desirable to have drilling fluids or muds which maintain thixotropy and rheology during operation and even in compositions with increased solids.

In one embodiment, well-drilling compositions are invert water-in-oil emulsions, generally having a density of 1000–2500 kg/m$^3$ (9 to 21 pounds per gallon). The drilling fluid or mud is generally composed of water, a clay, and a density increasing agent. Agents which increase density of drilling muds include galena (PbS), hematite ($Fe_2O_3$), magnetite ($Fe_3O_4$), ilmenite ($FeOTiO_2$), barite ($BASO_4$), siderite ($FeCO_3$), celesite ($SrSO_4$), dolomite ($CaCO_3.MgCO_3$), and calcite ($CaCO_3$). Density increasing agents may also be soluble salts such as sodium chloride, sodium bromide, sodium carbonate, potassium chloride, potassium carbonate, calcium bromide, zinc chloride, and zinc bromide. The drilling fluid or mud may also contain commercial clays. These clays include bentonite, attapulgite, sepiolite, etc. The preferred clay is bentonite. The drilling fluid may additionally contain other additives which enhance the lubricating properties of drilling fluids and mud. See, for example, U.S. Pat. Nos. 3,214,374 and 4,064,055. The composition of the present invention is included in such fluids, i.e. by mixing it with the emulsifier or dispersant employed to create an invert emulsion. The composition of the present invention is useful for, among other purposes, increasing the viscosity or inducing gellation of the fluid.

Other oil-field materials in which the materials of the present invention can be employed include enhanced oil recovery fluids, fracturing fluids, spotting fluids, fluid loss materials, and cementing materials.

Greases are a class of lubricants which are generally viscous materials containing an oil of lubricating viscosity and a thickening agent, as well as additional customary additives. The materials prepared by the present invention are useful as thickening agents for such greases; they can also provide corrosion and extreme pressure antiwear protection, which is normally supplied by the use of supplemental additives.

When used as a lubricants for abrasives, the solid overbased material of the present invention is generally employed as an additive for abrasive sheet material.

Not only are gelled materials easier to prepare using the process of the present invention than by previous methods, but there is also indication that in many instances greases prepared by the present process exhibit higher dropping points, improved homogeneity, and improved load-bearing, wear, and corrosion-protecting properties than their prior art counterparts. Furthermore, materials in all the above applications can be prepared without the use of heavy metals which are environmentally disfavored.

As used herein, the term "hydrocarbyl substituent" or "hydrocarbyl group" means a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms-other than carbon present in a chain or ring otherwise composed of carbon atoms.

EXAMPLES

Examples 1–16: Preparation of Overbased Materials

Example 1.

Distilled tall oil fatty acid, 1056 kg (2329 pounds), is placed in a reactor and combined with 1108 kg (2443 lb.) of 100 Neutral paraffinic oil and 190 kg (418 lb.) of calcium hydroxide. The mixture is heated with stirring to 95°–100° C. and held for 1 hour. The mixture is cooled to and maintained at 50°–55° C.; 103 kg (277 lb.) of a commercial isobutyl/amyl alcohol mixture and 256 kg (564 lb.) of calcium hydroxide are added. Carbon dioxide is bubbled into the mixture for 1 to 1.5 hours until a base number to phenolphthalein of 0–10 is reached. To the mixture is added 256 kg (564 lb.) Of calcium hydroxide, and additional carbon dioxide is bubbled into the mixture for 1 to 1.5 hours until a base number (phenolphthalein) of 0–10 is reached. Additional 256 kg (564 lb.) of calcium hydroxide is added and the mixture similarly carbonated for 1 to 1.5 hours to a base number of 0–10. The mixture is then heated to 160° C. to remove the alcohols and water of reaction. The material is cooled to ambient temperature and centrifuged for 1 hour at 1800 rpm to remove impurities. The product obtained is an overbased calcium tallate in oil.

Example 2.

Distilled tall oil fatty acid, 580 g, is placed in a reactor and combined with 1200 g Stoddard Solvent (a solvent similar to mineral spirits) and 89 g of calcium hydroxide. The mixture is heated with stirring to 95°–100° C. and held for 1 hour. The mixture is cooled to and maintained at 50°–55° C.; 100 g of isopropanol and 136 g of calcium hydroxide are added. Carbon dioxide is bubbled into the mixture at the rate of 28 L (1.0 standard cubic feet) per hour for 1 to 1.5 hours until a base number to phenolphthalein of 0–10 is reached. To the mixture are added 100 g of isopropanol and 136 g of calcium hydroxide, and additional carbon dioxide is bubbled into the mixture at the same rate for 1 to 1.5 hours until a base number (phenolphthalein) of 0–10 is reached. Additional 100 g isopropanol and 136 g of calcium hydroxide is added and the mixture similarly carbonated for 1 to 1.5 hours to a base number of 0–10. The mixture is then heated to 160° C. to remove the alcohols and water of reaction. The material is cooled to ambient temperature and centrifuged for 1 hour at 1800 rpm to remove impurities. The product obtained is an overbased calcium tallate in Stoddard Solvent.

Example 3.

Four hundred forty-nine g of purified low erucic rapeseed oil is placed in a reaction flask and combined with 692 g of 100N paraffinic oil, 33 g of glycerin, and 37 g. of calcium hydroxide. This mixture is heated with stirring to 140° C. and held at temperature for 4 hours. The material is cooled to 50°–55° C.; 173 g of isopropanol and 92 g of calcium hydroxide are added. Carbon dioxide is bubbled into the mixture at the rate of 28 L (1.0 standard cubic feet) per hour until a base number (phenolphthalein) of 0–10 is reached. Calcium hydroxide, 92 g, is added and similarly carbonated to a final base number of 0–10. The mixture is heated to 160° C. to remove isopropanol and water of reaction. The material is cooled to ambient temperature and centrifuged for 1 hour at 1800 rpm to remove impurities. The resulting product is an overbased calcium rapeseed acid in oil.

Example 4.

Example 3 is substantially repeated except that the 100N paraffinic oil is replaced by "SC-100", an aromatic solvent approximately equivalent to methyl ethyl benzene. In place of the final heating to 160° C., the mixture is heated to 140° C. to remove the isopropanol and water of reaction. After centrifugation, 93 g of SC-100 is added to adjust the material to 51% nonvolatile materials. The product is an overbased calcium rapeseed acid in SC-100.

Example 5.

Four hundred forty-nine grams of purified low erucic rapeseed oil is placed in a reaction flask and combined with 692 g of 100N paraffinic oil, 114 g glycerin, and 62 g calcium hydroxide. The mixture is heated with stirring to 140° C. and held for 4 hours, and thereafter treated as in Example 3, except two 124 g portions of calcium hydroxide are used. After centrifugation, 345 g of oil is added to adjust the material to 48% in oil. The product is an overbased calcium rapeseed acid in oil.

Example 6.

Example 5 is repeated except that in place of 100N paraffinic oil, SC-100 is used. The final heating to remove volatiles is to 140° C. The product obtained is an overbased calcium rapeseed acid in SC-100.

Example 7.

Charged to a 5 L 4-necked resin flask is 900 parts (3.1 equivalents) soybean oil, 1800 parts mineral spirits, and 85 parts glycerine. The flask is fitted with a stainless steel banana blade stirrer, a stainless steel subsurface gas inlet tube, a stainless steel thermowell, and a sidearm with a glass condenser. The contents are heated to 60° C. and 95 parts (2.57 equivalents) calcium hydroxide are added and the temperature is increased to reflux (about 155° C.). Reflux is maintained until the neutralization number is about 10 basic (about 2 hours). The batch is cooled to 60° C. and 90 parts isopropyl alcohol and 168 parts (4.54 equivalents) calcium hydroxide are added. Carbon dioxide is bubbled beneath the surface at 57 L (2 cubic feet) per hour to a neutralization number of between 7–12 basic. The sequence is repeated 2 more times using 98 parts isopropyl alcohol and 168 parts (4.54 equivalents) calcium hydroxide while blowing with carbon dioxide at 57 L (2 cubic feet) per hour to a neutralization number of between 7 and 12 basic, except the last increment is blown with carbon dioxide to less than 5 basic. Then 125 parts of soybean oil are added, and alcohol and water are stripped off by heating the contents to 120° C. At 50° C. the contents are clarified by dissolving in 3100 parts hexane and centrifuging the resultant solution at 1800 rpm for 1 hour. The liquid is decanted away from the solids and the liquid contents are then stripped at 130° C. at 2.7 kPa (20 mm mercury). The product obtained is an overbased calcium soyate in mineral spirits.

Example 8.

Example 7 is substantially repeated except that in place of mineral spirits, 100N paraffinic oil is used. The product obtained is an overbased calcium soyate in oil.

Example 9.

To a 3 L 4-necked resin flask fitted with the equipment of Example 7 is charged 584 parts (2.0 equivalents) soybean oil, 600 parts mineral spirits, and 65 parts glycerine. The contents are heated to 60° C. and 82.5 parts (2.2 equivalents) calcium hydroxide are added and the temperature is increased to reflux (about 155° C.). Reflux is maintained until a neutralization number is about 10 basic (about 2 hours). The batch is cooled to 60° C. and 100 parts isopropyl alcohol and 127 parts (3.4 equivalents) calcium hydroxide are added. Carbon dioxide is bubbled beneath the surface at 57 L (2 cubic feet) per hour to a neutralization number of about 7–12. The sequence is repeated 2 more times using 50 parts isopropyl alcohol and 127 parts (3.4 equivalents) calcium hydroxide while blowing with carbon dioxide at 57 L (2 cubic feet) per hour to a neutralization number of between 7–12, except the last increment is blown to less than 5. The contents are stripped of water and alcohol by heating to 70° C. while blowing with nitrogen at 28 L (1 cubic foot) per hour and later under a vacuum at 2.7 kPa (20 mm Hg). The product obtained is an overbased calcium soyate in mineral spirits.

Example 10.

Example 9 is repeated except that in place of mineral spirits, 100N paraffinic oil is used. The product is an overbased calcium soyate in oil.

Example 11.

Example 9 is repeated except that methyl oleate is used in place of soybean oil. The product is an overbased oleate in mineral spirits.

Example 12.

Example 10 is repeated except that methyl oleate is used in place of soybean oil. The product is an overbased oleate in oil.

Example 13.

Four hundred thirty-six g of purified coconut oil is placed in a reaction flask and combined with 500 g SC-100, 43 g of glycerin, and 89.5 g calcium hydroxide. The mixture is heated with stirring to 140° C. and held at temperature for 4 hours. The mixture is cooled to and maintained at 90° C., and 1000 g SC-100 and 100 g isopropanol are added. The temperature is further reduced to 50°–55° C. Calcium hydroxide, 132.8 g, is added and carbon dioxide is bubbled into the mixture at the rate of 28 L (1.0 standard cubic feet) per hour for 1–1.5 hours to a phenolphthalein base number of 0–10. Another charge of 132.8 g calcium hydroxide and 100 g isopropanol is added and the mixture is carbonated at the same rate for 1–1.5 hours to the same base number. Finally, another 132.8 g calcium hydroxide and 100 g isopropanol are added and, because of high viscosity, 1000 g of SC-100 is added. The mixture is carbonated at the same rate for 1–1.5 hours to the same base number. The mixture is heated to 157° C. to remove the isopropanol and water of reaction. The material is cooled to 50° C., 1220 g of SC-100 is added and mixed in for 0.5 hours, and the material is centrifuged for 1 hour at 1800 rpm. The decantate is the product, which is an overbased calcium coconut acid in SC-100.

Example 14.

Four hundred thirty-six g of purified coconut oil is placed in a reaction flask and combined with 500 g o-xylene, 43 g of glycerin, and 81.4 g calcium hydroxide. The mixture is heated With stirring to 140° C. and held at temperature for 4 hours. The mixture is cooled to and maintained at 80°–82° C., and 950 g o-xylene, 150 g isopropanol, and 124.9 g calcium hydroxide are added. Carbon dioxide is bubbled into the mixture at the rate of 42 L (1.5 standard cubic feet) per hour for 1–1.5 hours to a phenolphthalein base number of 0–10. Another 124.9 g calcium hydroxide is added and carbonated at the same rate to the same base number; a final charge of 124.9 g calcium hydroxide is added and similarly carbonated. The mixture is heated to 140° C. to remove the isopropanol and water of reaction. The material is cooled to 50° C., 1000 g of hexane is added and mixed, and the mixture centrifuged for i hour at 1600 rpm. The decantate is stripped to 139° C. to remove the hexane, leaving 1721 g of the product. The product is an overbased calcium coconut acid in o-xylene.

Example 15.

Three hundred ninety-eight g of hydrogenated palm oil is placed in a reaction flask and combined with 1200 g o-xylene, 33 g of glycerin, and 37 g calcium hydroxide. The mixture is heated with stirring to 140° C. and held at temperature for 4 hours. The mixture is cooled to and maintained at 80°–82° C., and 200 g isopropanol and 111 g calcium hydroxide are added. Carbon dioxide is bubbled into the mixture at the rate of 28 L (1 standard cubic feet) per hour for 1–1.5 hours to a phenolphthalein base number of 0–10. Another 111 g calcium hydroxide is added and carbonated at the same rate to the same base number; a final charge of 111 g calcium hydroxide is added and similarly carbonated. The mixture is heated to 140° C. to remove the isopropanol and water of reaction. The material is cooled to 50° C. and centrifuged for 1 hour at 1800 rpm to remove impurities. The product is an overbased calcium hydrogenated palmate in o-xylene.

Example 16.

Example 14 is repeated except that in place of coconut oil, 436 g of hydrogenated castor oil is used. The product obtained is an overbased calcium hydrogenated castor acid in o-xylene.

Examples 17–34—Gelation Reactions

Example 17 (comparative)

Into a reaction flask is placed 1181 g of the overbased material of Example 1 and combined with 1297 g of 100N paraffinic oil, 372 g of commercial isobutyl/amyl alcohol mixture, and 124 g of water. The mixture is heated with stirring to reflux at approximately 92° C. and held for 8½ hours The mixture is allowed to cool overnight to ambient temperature. The material is reheated to reflux; after 1 additional hour, the material is gelled as indicated by an increase in viscosity; there also appears an absorption band at 873 $cm^{-1}$ in the IR spectrum, characteristic of calcite. The mixture as held at reflux for approximately 2 hours after gelation is complete and then heated to 160° C. to remove water and isobutanol gelation solvents. The remaining material is Cooled to ambient temperature. The product obtained is a tan, opaque grease.

Example 18.

Nine hundred grams of the overbased material of Example 1 is placed in a reaction flask and combined with 750 g paraffinic bright stock, 750 g of a 500N paraffinic oil, 240 g of isopropanol, 60 g water, and 40 g calcium hydroxide. This mixture is heated with stirring to 50° C. over 0.5 hours, at which time a mixture of 60 g acetic acid and 60 g water is added dropwise over 0.5 hours at 50°–65° C. After the addition is complete, the materials are stirred and heated to reflux at approximately 82° C. After the material is maintained at reflux for approximately 1.5 hours, the materials have gelled, as indicated by an increase in viscosity and separation of the alcohol and water from the bulk of the mixture. The materials are held at reflux with stirring for approximately 1 hour after the gelation is complete and then heated to 160° C. to remove the water and isopropanol gelation solvents. The resulting material is cooled with stirring to 80° C. or less. The product obtained is a clear brown grease.

Example 19.

Eleven hundred twelve grams of the overbased material of Example 4 and 333 g of 100N paraffinic oil are placed in a reaction vessel, heated to 150° C., and vacuum stripped, 4.7 kPa (35 mm Hg), to dryness to remove the SC-100. The mixture is cooled to 50° C. and the procedure of Example 18 is repeated, except 65 g of calcium hydroxide is used. The product obtained is a clear, brown grease.

Example 20.

Example 19 is repeated except that in place of the material of Example 4, 1082 g of the material of Example 6, 305 g of 100N paraffinic oil, 687 g of paraffinic bright stock, 687 g of 500N paraffinic oil, 220 g of isopropanol, 55 g of water, 59.5 g of calcium hydroxide, and a solution of 55 g acetic acid and 55 g of water are used. The product obtained is a clear, brown grease.

Example 21.

Eight hundred grams of the overbased material of Example 7, 148 g of paraffinic bright stock, and 252 g of 500N paraffinic oil are placed in a reaction vessel, heated to 150° C., and vacuum stripped, 4.7 kPa (35 mmHg) to dryness to remove the mineral spirits. The mixture is cooled to 50° C. and the procedure of Example 18 is repeated except that 473 g of paraffinic bright stock, 806 g of 500N paraffinic oil, 300 g of isopropanol, 75 g of water, 37 g of calcium hydroxide, and a solution of 63 g acetic acid and 75 g of water are used. The product obtained is a clear brown grease.

Example 22.

Example 18 is repeated except that in place of 900 g of the material of Example 1, 841 g of the material of Example 10 and 59 g of 100N paraffinic oil are used.

Example 23.

Example 22 is repeated except that in place of the material of Example 10, the material of Example 12 is used. Example 24.

Example 18 is repeated except that in place of paraffinic bright stock and 500N paraffinic oil, rapeseed oil is used. The amounts of materials are 1350 g of the material of Example 1, 66 g of 100N paraffinic oil, 1416 g of rapeseed oil, 270 g of isopropanol, 70 g of water, 97.5 g of calcium hydroxide, and a solution of 90 g acetic acid and 65 g of water. After the resulting material is cooled with stirring to 80° C. or less, 896 g of rapeseed oil is added and the mixture stirred for 0.5 hour. The product obtained is a tan, translucent grease.

Example 25.

Example 19 is repeated except that in place of paraffinic bright stock and 500N paraffinic oil, rapeseed oil is used.

Example 26.

Example 20 is repeated except that in place of paraffinic bright stock and 500N paraffinic oil, rapeseed oil is used.

Example 27.

Example 21 is repeated except that in place of paraffinic bright stock and 500N paraffinic oil, rapeseed oil is used. The amounts 2used are 600 g of the material of Example 7, 500 g of rapeseed oil (in the first addition), 415 g of rapeseed oil (in the second addition), 140 g of isopropanol, 30 g of water, 27.8 g of calcium hydroxide, and a solution of 47.6 g of acetic acid and 40 g of water.

Example 28.

Example 22 is repeated except that in place of paraffinic bright stock and 500N paraffinic oil, rapeseed oil is used.

Example 29.

Example 23 is repeated except that in place of paraffinic bright stock and 500N paraffinic oil, rapeseed oil is used.

Example 30.

Fourteen hundred grams of the overbased material of Example 7 is placed in a reaction flask and combined with 13.7 g of paraffinic bright stock and 23.3 g of 500N paraffinic oil, and thereafter treated as in Example 18 with 400 g of isopropanol, 100 g of water, 65 g of calcium hydroxide, and a solution of 111 g of acetic acid and 100 g of water. After the ingredients have been heated to 160° C. to remove the Water and isopropanol, 2621 g of mineral spirits are added while cooling to ambient temperature to give a grease containing about 29% non-volatile content.

Example 31.

Six hundred grams Of the overbased material of Example 7 is placed in a reaction flask and combined with 600 g mineral spirits, and thereafter treated as in Example 18 with 140 g of isopropan01, 30 g of water, 27.6 g of calcium hydroxide, and a solution of 47.6 g of acetic acid and 40 g water. After the contents have been heated to 160° C. to remove the isopropanol and water, 915 g of rapeseed oil is added and the contents are vacuum stripped to dryness at 4.7 kPa (35 mm Hg), to remove the mineral spirits. Rapeseed oil, 343 g, is added while cooling to 80° C. or less, to give a grease.

Example 32.

The overbased material of Example 14, 2367 g, is placed in a reaction flask and combined with 633 g of o-xylene, 300 g of isopropanol and 150 g water. The mixture is heated with stirring to reflux, approximately 83° C., and maintained at reflux for a total of 16 hours over 3 days. At this time the material will be gelled. The mixture is held at reflux for 3 additional hours and then heated to 122° C. to remove the water and isopropanol. To the mixture are added 110 g coconut oil and 2514 g of o-xylene. The material is cooled to ambient temperature to give a stiff gel with 42.4% non-volatile materials.

Example 33.

The overbased material of Example 14, 6021 g, is placed in a reaction flask and combined with 1611 g o-xylene, 763 g isopropanol, 191 g water, and 199.5 g calcium hydroxide. The mixture is heated with stirring to 50° C. over 0.5 hours, at which time a mixture of 163.5 g acetic acid and 191 g water is added dropwise over 0.5 hours at 50°-65° C. After the addition is complete, the mixture is heated to reflux, approximately 82° C., and maintained at that temperature for 1.5 hours, at which time gellation is complete. The materials are maintained at reflux for approximately an additional 1 hour after gelation is complete and then heated to 140° C. to remove the water and isopropanol. Coconut oil, 309 g, is added. The material is cooled to ambient temperature to give a stiff gel with approximately 45% non-volatile materials.

Example 34.

One thousand six hundred seventy-five grams of the overbased material of Example 14 is placed in a reaction flask and combined with 168 g isopropanol and 27.4 g calcium hydroxide. The mixture is heated to 50° C. over 0.5 hours, at which time a mixture of 84 g water and 59.5 g calcium acetate is added over 0.5 hours at 50°-65° C. After the addition is complete, the materials are held at reflux at approximately 82° C. Until gelation has occurred. The materials are maintained at reflux for approximately an additional 1 hour after gelation is complete and then heated to 140° C. to remove the water and isopropanol. Coconut oil, 85.9 g, and 2240 g of o-xylene are added while cooling to ambient temperature to give a grease with 25% non-volatile materials.

Example 35.

The overbased material from Example 15, 777 g, is placed in a reaction flask with 223 g of o-xylene, 100 g of isopropanol, 25 g of water, and 35.5 g of calcium hydroxide. The mixture is heated with stirring to 50° C. over 0.25 hours, at which time a mixture of 41.4 g acetic acid and 25 g of water is added dropwise over 0.15 hours at 50°-60° C. After the addition is Complete, the mixture is heated to reflux, 82° C., and held for 1.5 hours until gelation is complete. The materials are maintained at reflux for 1 hour after gelation is Complete and then heated to 132° C. to remove water and isopropanol. Coconut oil, 43.7 g, is added. The mixture is cooled to ambient temperature to give a stiff gel with approximately 45.3% non-volatile materials.

Example 36.

The overbased material from Example 16, 738 g, is placed in a reaction flask with 100 g isopropanol and 50 g water. The mixture is heated with stirring to reflux, 82° C., and held for 10 hours over 2 days at that temperature, at which time the gelation is complete. Four hundred g of o-xylene is added and the mixture is held at reflux for 1 additional hour. The mixture is then heated to 140° C. to remove the water and isopropanol. Coconut oil, 30 g, is added and the mixture is cooled to ambient temperature to give a very stiff gel with approximately 32% non-volatile materials.

Examples 37–48—Preparation of Powders and Greases

Example 37.

Example 30 is repeated except after gelation the mixture is transferred to a tray and vacuum dried, 4.7 kPa (35 mm Hg) at 70°-80° C. to obtain a powder.

Example 38.

Example 32 is repeated except that at the end of the procedure the material is transferred to a tray and vacuum dried at 4.7 kPa (35 mmHg) at 70°-80° C. to obtain a powder.

Example 39.

Example 33 is repeated except that at the end of the procedure the material is transferred to a tray and vacuum dried at 4.7 kPa (35 mm Hg) at 70°-80° C. to obtain a powder.

Example 40.

Example 34 is repeated except after gelation, 755 g of o-xylene and 85.9 g of Coconut oil are added with stirring. The mixture is transferred to tray and vacuum dried at 4.7 kPa (35 mm Hg) at 70°-80° C.

Example 41.

Example 35 is repeated, except at the end of the procedure the material is transferred to a tray and vacuum dried at 47 kPa (35 mm Hg) at 70°-80° C. to obtain a powder.

Example 42.

Example 36 is repeated except at the end of the procedure the material is transferred to a tray an vacuum dried at 4.7 kPa (35 mmHg) at 70°-80° C. to obtain a powder.

Example 43.

The powder from Example 37, 600 g, is placed in a Ross TM Mixer and combined with 1470 g of an 800N paraffinic oil. The mixture is heated with stirring to 150° C. and held at temperature for 2 hours. The material is cooled to ambient temperature and milled twice an a three-roll mill. The product obtained is a grease.

Example 44.

Example 43 is repeated except that the paraffinic oil is replaced with rapeseed oil.

Example 45.

The powder from Example 39, 810 g, is placed in a reaction flask and combined with 2790 g of 800N mineral oil. The mixture is heated with stirring to 175° C. under nitrogen over 3 hours, then cooled to ambient temperature. The mixture is milled twice on a 3-roll mill, and the product obtained is a grease.

Example 46.

Example 45 is repeated using rapeseed oil in place of 800N paraffinic oil.

Example 47.

Example 45 is repeated except that the powder from Example 40 is used.

Example 48.

Example 47 is repeated using rapeseed oil in place of 800N paraffinic oil.

Examples 49 and 50: Formulations

Example 49.

To the grease of Example 18 is added 3% by weight of a sulfur-phosphorus extreme pressure additive package to provide a fully formulated grease.

Example 50.

The solid material of Example 37, 500 g, is mixed with 1570 g of a 120Neutral paraffinic oil. To this mixture is added 40 g of a sulfur-phosphorus extreme pressure gear oil additive package, to provide a semi-fluid grease for open gear lubrication or cam lubrication.

Examples 51–59

Example 51.

The ingredients of Example 18 are combined except that the 60 g acetic acid is replaced by 74 g propionic acid. The mixture is heated with stirring at reflux until gelation occurs and then further treated as in Example 18.

Example 52.

Example 51 is repeated except that the propionic acid is replaced by 124 g propanesulfonic acid.

Example 53.

Example 51 is repeated except that the propionic acid is replaced by 77 g ammonium acetate.

Example 54.

The ingredients of Example 18 are combined except that the overbased material of Example 1 is replaced by an equivalent amount of a calcium carbonate overbased mahogany sulfonate having a metal ratio of 10. The mixture is heated to with stirring until the gelation occurs, after which the composition is treated as in Example 18.

Example 55.

Example 18 is repeated except that 300 g acetic acid and 200 g of calcium hydroxide are used.

Example 56.

Example 18 is repeated except that 20 g acetic acid and 13 g calcium hydroxide are used.

Example 57.

(A) Three hundred twenty grams of distilled tall oil fatty acid is placed in a reaction flask and combined with 405 g of 100 Neutral paraffinic oil, 60 g of acetic acid, and 154.7 g of calcium hydroxide. The mixture is heated with stirring to 95°–100° C and held for 1 hour. The mixture is cooled to and maintained at 50°–55° C.; 50 g of isopropanol and 85.1 g of calcium hydroxide are added. Carbon dioxide is bubbled into the mixture at the rate of 14 L (0.5 standard cubic feet) per hour for 1 to 1.5 hours until a base number to phenolphthalein of 0–10 is reached. To the mixture are added 50 g of isopropanol and 85.1 g of calcium hydroxide, and additional carbon dioxide is bubbled into the mixture at the same rate for 1 to 1.5 hours until a base number (phenolphthalein) of 0–10 is reached. Additional 50 g isopropanol and 85.1 g of calcium hydroxide are added and the mixture similarly carbonated for 1 to 1.5 hours to a base number of 0–10. The mixture is then heated to 160° C. to remove isopropanol and water of reaction. The material is cooled to ambient temperature and centrifuged for 1 hour at 1800 rpm to remove impurities. The product obtained is an overbased calcium mixed acetate-tallate in oil.

(B) Nine hundred grams of the overbased material of (A) is placed in a reaction flask and combined with 750 g paraffinic bright stock, 750 g of a 500N paraffinic oil, 240 g of isopropanol, and 120 g water. This mixture is heated with stirring to reflux until the materials have gelled. The materials are held at reflux with stirring for approximately 1 hour after the gelation is complete and then heated to 160° C. to remove the water and isopropanol gelation solvents. The resulting material is cooled with stirring to 80° C. or less.

Example 58.

Four hundred fifty grams of the overbased material from Example 1 is placed in a reaction flask and combined with 375 g of paraffinic bright stock, 375 g of 500N paraffinic oil, 32.5 g of calcium hydroxide, and 62.5 g water. The mixture is heated with stirring to 50° C. and a mixture of 36.5 g adipic acid and 145 g of isopropanol is added dropwise over 0.25 hours. After the addition is complete, the materials are stirred and heated to reflux, approximately 82° C. The mixture is maintained at reflux for a total of 8 hours over 2 days, after which time no gelation has occurred, suggesting that the use of adipic acid alone is less effective at inducing gelation than use of some other acids. The mixture is cooled to 50° C., 20 g of calcium hydroxide and a solution of 30 g of acetic acid and 30 g of water are added, and the mixture is reheated to reflux at about 82° C. After 0.5 hours gelation has occurred. The materials are maintained at reflux for 1 hour, and then heated to 125° C. to remove the water and isopropanol gelation solvents. The mixture is cooled with stirring to 80° C. or less to obtain a grease.

Each of the documents referred to above is incorporated herein by reference. Except in the Examples, or where otherwise explicitly indicated, all numerical quantities in this description specifying amounts of materials, number of atoms, reaction conditions, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. As used herein, the expression consisting essentially of permits the inclusion of substances which do not materially affect the basic and novel characteristics of the composition under consideration.

What is claimed is:

1. A process for preparing a gelled overbased material, comprising the steps of:

(a) preparing a mixture of (i) a fluid carbonated overbased material in an oleophilic medium, which mixture contains a metal salt of at least one organic acid material containing at least 8 carbon atoms and a metal salt of at least one organic acid material containing fewer than 6 carbon atoms, and (ii) an alcohol or an alcohol-water mixture; and (b) heating the mixture of (a).

2. The process of claim 1 wherein the fluid carbonated overbased material is prepared by reacting a mixture of at least one organic acid material containing at least 8 carbon atoms or a reactive equivalent thereof and at least one organic acid material containing fewer than 6 carbon atoms or a reactive equivalent thereof with a stoichiometric excess of a metal salt and carbonating the mixture.

3. The process of claim 1 wherein the fluid carbonated overbased material is prepared by reacting at least one organic acid material containing at least 8 carbon atoms or a reactive equivalent thereof with a stoichiometric excess of a metal salt, carbonating the mixture, and adding to the mixture a metal salt of an organic acid material containing fewer than 6 carbon atoms or a substance which forms a metal salt of an organic acid material containing fewer than 6 carbon atoms upon interaction with a metallic base.

4. The process of claim 1 wherein the oleophilic medium is an oil.

5. The process of claim 1 wherein the oleophilic medium is a volatile organic solvent.

6. The process of claim 1 wherein the carbonated overbased material of component (i) comprises about 1 to about 70 percent by weight of the composition of component (i).

7. The process of claim 1 wherein the metal of the salt of the acid material of at least 8 carbon atoms and the metal of the salt of the organic acid material containing fewer than 6 carbon atoms are calcium.

8. The process of claim 1 wherein the organic acid material containing at least 8 carbon atoms is a carboxylic acid.

9. The process of claim 8 wherein the carboxylic acid contains 10 to about 22 carbon atoms.

10. The process of claim 1 wherein the organic acid material containing fewer than 6 carbon atoms is a carboxylic acid.

11. The process of claim 10 wherein the carboxylic acid contains 1 to 4 carbon atoms.

12. The process of claim 10 wherein the carboxylic acid is a monocarboxylic acid.

13. The process of claim 11 wherein the carboxylic acid is acetic acid.

14. The process of claim 1 wherein the molar ratio of the acidic organic material of fewer than 6 carbon atoms to the acidic organic material of at least 8 carbon atoms is about 0.3:1 to about 5:1.

15. The process of claim 14 wherein the molar ratio is about 0.5:1 to about 2:1.

16. The process of claim 1 wherein the metal ratio of the carbonated overbased material is about 1.5 to about 30.

17. The process of claim 1 wherein the alcohol or alcohol water mixture is a mixture comprising isopropanol and water.

18. The process of claim 1 wherein the amount of the alcohol or alcohol water mixture of (ii) is about 5 percent to about 30 percent by weight of the fluid composition of (i).

19. The process of claim 1 wherein the mixture of (i) and (ii) is heated in step (b) to about 60° to about 100° C.

20. The process of claim 1 further comprising the step of (c) heating the mixture to about 100° to about 200° C. after the step of (b), thereby removing volatile materials from the mixture.

21. The process of claim 1, further comprising the step of removing at least a substantial portion of the medium and isolating a resulting solid.

22. The process of claim 21 wherein the medium is a volatile organic solvent which is removed by evaporation.

23. The process of claim i further comprising the steps of:

(d) admixing the material obtained from step (b) with a replacement medium; and (c) removing the oleophilic medium.

24. The product of the process of claim 1.

25. The product of the process of claim 21.

26. The product of the process of claim 23.

27. A process for preparing an overbased composition, comprising the steps of:

(a) combining a source of an acid of at least 8 carbon atoms, a polar oleophilic medium, and a stoichiometric excess of a metal base; and (b) carbonating the mixture.

28. The process of claim 27 wherein the polar oleophilic medium is an aromatic material having a dielectric contstant of at least about 2.4 at 20° C.

29. The process of claim 27 wherein the polar oleophilic medium is ortho-xylene.

30. The process of claim 27 wherein the acid is a saturated carboxylic acid.

31. The process of claim 30 wherein the source of the saturated carboxylic acid is the saturated carboxylic acid or an ester, amide, anhydride, or salt thereof.

32. The process of claim 30 wherein the source of the saturated carboxylic acid is a triglyceride of the acid.

33. The process of claim 30 wherein the saturated carboxylic acid contains about 12 to about 30 carbon atoms.

34. The process of claim 30 wherein the saturated carboxylic acid is coconut acid, hydrogenated palmitic acid, hydrogenated castor acid, stearic acid, 12-hydroxystearic acid, or 14-hydroxyarachidic acid.

35. The process of claim 27 wherein the metal base is calcium oxide or calcium hydroxide.

36. The process of claim 27 wherein the reaction mixture also contains an alcohol.

37. The process of claim 29 wherein the carbonation is conducted at about 7D to about 95° C.

38. The process of claim 29 wherein the carbonation is conducted at about 80° to about 85° C.

39. A process for preparing an overbased composition, comprising the steps of:

(a) combining a source of an acid of at least 8 carbon atoms, a polar oleophilic medium, and a stoichiometric excess of a metal base; and (b) carbonating the mixture at about 70° to about 95° C.

40. The process of claim 39 wherein the acid is a saturated carboxylic acid.

41. The process of claim 39 wherein the carbonation is conducted at about 80° to about 85° C.

42. The product of the process of claim 27.

43. The product of the process of claim 39.

44. The process of claim 27, further comprising gelling the overbased product.

45. The process of claim 27, further comprising the steps of:

(c) admixing to the carbonated mixture (i) a metal salt of an organic acid material containing fewer than 6 carbon atoms or a substance which forms such a salt upon interaction with a metallic base and (ii) an alcohol or an alcohol-water mixture; And (d) heating the mixture of (c) .

46. The process of claim 27, wherein a salt of an organic acid material having fewer than 6 carbon atoms or a substance which forms such a salt upon interaction with a metal base is combined with the components in step (a), said process further comprising the steps of:

(c) admixing to the carbonated mixture an alcohol or an alcohol-water mixture and (d) heating the mixture of (c).

47. The process of claim 39, further comprising gelling the overbased product.

48. The process of claim 39, further comprising the steps of:

(c) admixing to the carbonated mixture (i) a metal salt of an organic acid material containing fewer than 6 carbon atoms or a substance which forms such a salt upon interaction with a metallic base and (ii) an alcohol or an alcohol-water mixture; and (d) heating the mixture of (c).

49. The process of claim 39, wherein a salt of an organic acid material having fewer than 6 carbon atoms or a substance which forms such a salt upon interaction with a metal base is combined with the components in step (a), said process further comprising the steps of:

(c) admixing to the carbonated mixture an alcohol or an alcohol-water mixture and (d) heating the mixture of (c).

50. The process of claim 44, further comprising the step of removing at least a substantial portion of the polar oleophilic medium and isolating a resulting solid.

51. The process of claim 47, further comprising the step of removing at least a substantial portion of the polar oleophilic medium and isolating a resulting solid.

52. The product of the process of claim 50.

53. The product of the process of claim 51.

54. The product prepared by admixing the product prepared by the process of claim 25 with an oleophilic medium.

55. The product prepared by admixing the product prepared by the process of claim 52 with an oleophilic medium.

56. The product prepared by admixing the product prepared by the process of claim 53 with an oleophilic medium.

57. A lubricant composition which comprises an overbased material prepared by the process of claim 1.

58. A coating composition which comprises an overbased material prepared by the process of claim 1.

59. A polymeric composition which comprises a polymer and an overbased material prepared by the process of claim 1.

60. A drilling mud which comprises an overbased material prepared by the process of claim 1.

61. An abrasive composition which comprises an overbased material prepared by the process of claim 21.

62. A lubricant composition which comprises an overbased material prepared by the process of claim 27.

63. A coating composition which comprises an overbased material prepared by the process of claim 27.

64. A polymeric composition which comprises a polymer and an overbased material prepared by the process of claim 27.

65. A drilling mud which comprises an overbased material prepared by the process of claim 27.

66. An abrasive composition which comprises an overbased material prepared by the process of claim 50.

67. A lubricant composition which comprises an overbased material prepared by the process of claim 39.

68. A coating composition which comprises an overbased material prepared by the process of claim 39.

69. A polymeric composition which comprises a polymer and an overbased material prepared by the process of claim 39.

70. A drilling mud which comprises an overbased material prepared by the process of claim 39.

71. An abrasive composition which comprises an overbased material prepared by the process of claim 51.

* * * * *